US010920344B2

(12) United States Patent
Bruske et al.

(10) Patent No.: US 10,920,344 B2
(45) Date of Patent: Feb. 16, 2021

(54) REED AND METHOD FOR PRODUCING SAME

(71) Applicant: Groz-Beckert KG, Albstadt (DE)

(72) Inventors: Johannes Bruske, Albstadt (DE); Gerhard Braun, Dotternhausen (DE); Peter Meinert, Balingen (DE); Stephen Wohnhas, Meßstetten (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 16/628,821

(22) PCT Filed: Jul. 6, 2018

(86) PCT No.: PCT/EP2018/068369
§ 371 (c)(1),
(2) Date: Jan. 6, 2020

(87) PCT Pub. No.: WO2019/008138
PCT Pub. Date: Jan. 10, 2019

(65) Prior Publication Data

US 2020/0299874 A1 Sep. 24, 2020

(30) Foreign Application Priority Data

Jul. 7, 2017 (EP) ..... 17180271

(51) Int. Cl.
*D03D 49/62* (2006.01)
*D03D 49/68* (2006.01)
*D03D 13/00* (2006.01)

(52) U.S. Cl.
CPC ..... *D03D 49/62* (2013.01); *D03D 49/68* (2013.01); *D03D 13/008* (2013.01)

(58) Field of Classification Search
CPC ..... D03D 49/62; D03D 47/265; D03D 49/68; D03D 47/277; D03D 13/008; D03D 49/60; D03C 3/38
See application file for complete search history.

(56) References Cited

U.S. PATENT DOCUMENTS 2,147,258 A * 2/1939 Kaufmann ..... D03D 49/62 28/212
2,152,430 A * 3/1939 Hassold ..... D03D 49/62 28/199

(Continued)

FOREIGN PATENT DOCUMENTS

CN 2564593 Y 8/2003
CN 101260592 A 9/2008

(Continued)

OTHER PUBLICATIONS

Extended European Search Report dated Jan. 9, 2018, in corresponding European Application No. 17180271.3 (8 pages).

(Continued)

*Primary Examiner* — Robert H Muromoto, Jr.
(74) *Attorney, Agent, or Firm* — Fitch, Even, Tabin & Flannery LLP

(57) ABSTRACT

A reed and a method for producing a reed. The reed has a multiplicity of dents, which are arranged in a width direction, forming interspaces each having a dent spacing. Each dent has two opposite end sections, at which the dents are respectively connected to a carrier and to the immediately adjacent dent or dents by an adhesive connection. In at least one end section, the dent has a plurality of a spacer studs, which are preferably produced by embossing. The spacer studs form a depression on the one, first side and, on the opposite, second side, form a projection having a stud outer surface. The sum of all the stud outer surfaces of the spacer (Continued)

studs of a single end section of a dent has a proportion of at most 15% of the total end section surface on this second side.

14 Claims, 5 Drawing Sheets

(56) References Cited

U.S. PATENT DOCUMENTS 3,746,053 A * 7/1973 Crain ..... D03D 49/62 139/192
3,965,940 A * 6/1976 Marty ..... D03D 49/62 139/192
4,071,052 A * 1/1978 Vasek ..... D03D 47/265 139/188 R
4,290,458 A * 9/1981 Steiner ..... D03D 41/005 139/28
4,328,842 A * 5/1982 Scheffel ..... D03D 47/278 139/435.5
4,529,014 A * 7/1985 Rast ..... D03D 47/278 139/192
4,694,867 A * 9/1987 Gendelman ..... D03D 47/278 139/192
4,844,131 A * 7/1989 Anderson ..... D03D 49/62 139/192
4,887,650 A * 12/1989 McGinley ..... D03D 49/60 139/460
5,029,617 A * 7/1991 Anderson ..... D03D 49/62 139/192
5,046,533 A * 9/1991 Corain ..... D03D 47/265 139/192
5,158,116 A * 10/1992 Kazuo ..... D03D 49/62 139/192
5,289,852 A * 3/1994 Migliorini ..... D03D 49/62 139/192
5,421,373 A * 6/1995 Hacker ..... D03D 49/68 139/192
5,465,762 A * 11/1995 Farley ..... D03D 49/68 139/192
5,570,725 A * 11/1996 Musha ..... D03D 49/62 139/192
5,598,875 A * 2/1997 Musha ..... D03D 13/008 139/1 R
6,039,087 A * 3/2000 Thompson, III ..... D03D 47/278 139/192
6,575,201 B2 * 6/2003 Buesgen ..... D03D 1/0005 139/387 R
7,467,646 B2 * 12/2008 Mettler ..... D03C 9/02 139/92
9,145,625 B2 * 9/2015 Zhang ..... D01G 15/88
9,200,385 B2 * 12/2015 Dambrine ..... D03C 3/38
10,626,527 B2 * 4/2020 Bruske ..... D03D 47/277
2015/0114511 A1 * 4/2015 Dambrine ..... D03D 41/00 139/86
2018/0057980 A1 * 3/2018 Bruske ..... D03D 47/277

FOREIGN PATENT DOCUMENTS

DE 1535830 A 7/1970
DE 2508575 A1 9/1975
EP 0943712 A1 9/1999
EP 3067451 A1 9/2016
FR 1146831 A 11/1957
FR 2776310 A1 9/1999
GB 1245872 A 9/1971

OTHER PUBLICATIONS

International Search Report dated Oct. 2, 2018 and Written Opinion dated Sep. 24, 2018, in corresponding International Application No. PCT/EP2018/068369, with machine English translation (15 pages).
International Report on Patentability dated Jun. 24, 2019, in corresponding International Application No. PCT/EP2018/068369, with machine English translation (25 pages).
Chinese Office Action dated Dec. 21, 2020, in corresponding Chinese Application No. 201880045230.6, with English translation (18 pages).

* cited by examiner

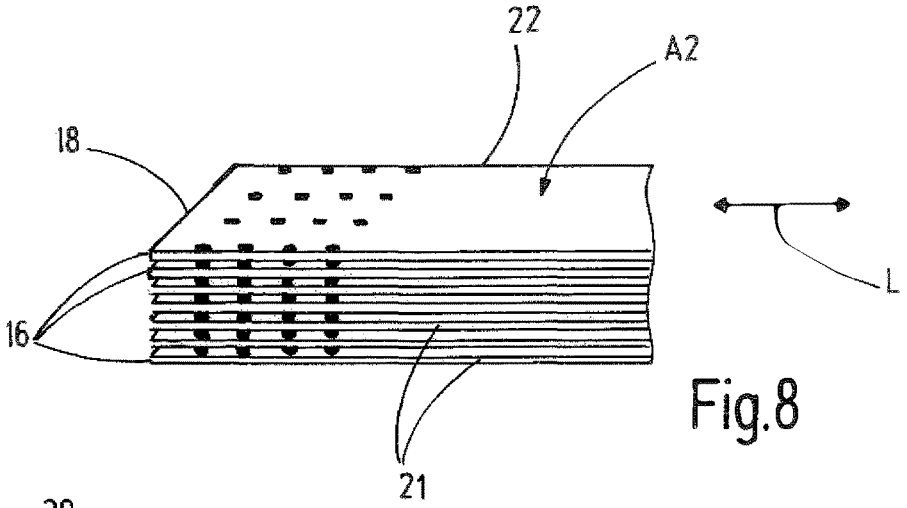
Fig.8
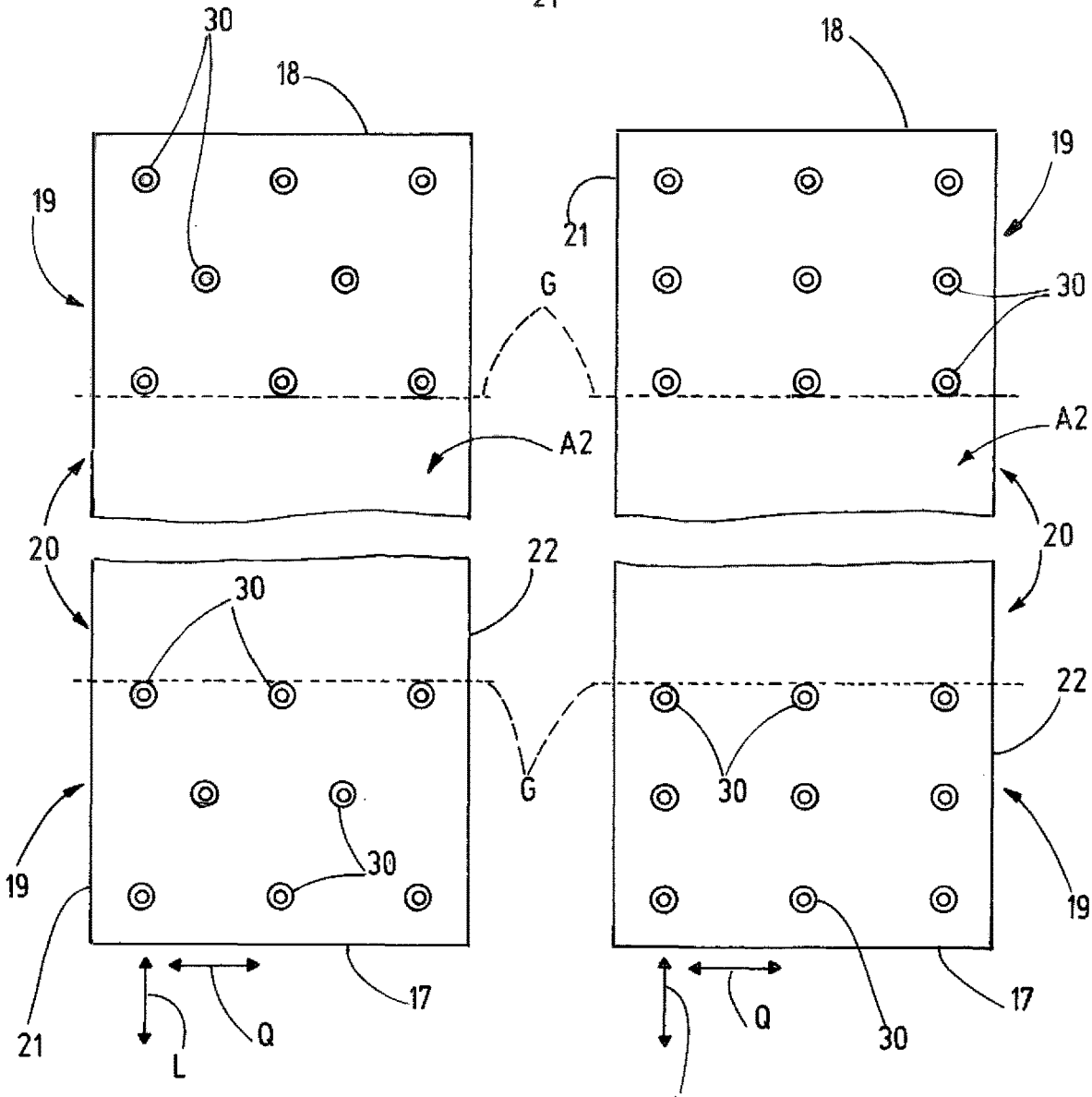
Fig.9
Fig.10

REED AND METHOD FOR PRODUCING SAME

CROSS REFERENCE TO RELATED APPLICATIONS

This patent application is the national phase of PCT/EP2018/068369, filed Jul. 6, 2018, which claims the benefit of European Patent Application 17180271.3, filed Jul. 7, 2017.

TECHNICAL FIELD

The invention relates to a reed and a method for producing a reed. A reed comprises a plurality of dents arranged parallel to each other. Two directly adjacent dents limit an interspace respectively through which one warp thread is guided respectively. The dents serve to keep the warp threads at a defined distance relative to each other. In order to be able to manufacture a regular woven textile, it is necessary that all directly adjacent dents have the same distance to each other.

BACKGROUND

In order to predefine the distance of dents of a reed during assembly, it is known from FR 1 146 831 A to bend the dent in its two end sections a plurality of times, such that a serration-shaped dent section is created. The serration-shaped sections of adjacent dents are offset from each other in a longitudinal direction in which the dent extends. An adjacent dent abuts at a serration of a dent, such that the distance or the width of the interspace between two dents is defined.

Dents of a reed formed like this are also disclosed in U.S. Pat. No. 2,152,430 A. Additionally, a further embodiment of dents is shown there in which an end section is bent about 180° and the bent portion is shaped to a projection at which the respective adjacent dent abuts.

U.S. Pat. No. 2,147,258 A describes dents of a reed that are provided with two parallel slits in an end section in its extension direction, such that three webs are created in this way. The middle web is formed to project in one direction and the two outer webs are formed to project in the other direction from the plane of the dent. In doing so, spacer projections are formed at which directly adjacent dents are in contact. Such dents are also known from DE 2 508 575 A.

EP 0 943 712 A1 and U.S. Pat. No. 4,529,014 describe a reed in which the end sections of the dents are configured with increased thickness compared with the middle working section of the dents and abut each other. In doing so, a defined distance between the working sections of the dents is achieved.

The dents of a reed known from DE 1 535 830 A are provided with a through-hole through which a string rail extends. The dents are bent about 180° adjoining the through-hole. The thickness of the bent areas defines the distance between two directly adjacent dents that abut each other.

GB 1 245 872 A describes an embodiment of a reed with the goal to increase the distance between two parallel planes that contact a dent on opposite sides without the need to increase the width of the dent. This shall be achieved by configuring the cross-section profile of the dent in a curved or bent manner. One plane abuts at a middle area of the convex side, whereas the other plane abuts at the two outer areas of the cross-section of the dent at the concave side. The larger the bend or the curvature of the cross-section profile is, the larger the distance becomes between these two planes.

Starting from the prior art it can be considered as object of the present invention to provide a reed that guarantees a constant distance between adjacent warp threads.

SUMMARY

This object is solved by a reed as well as a method for producing the reed as disclosed herein.

The inventive reed comprises multiple dents that extend in a longitudinal direction between a first end and an opposite second end. Each dent has an end section directly adjoining the first end as well as directly adjoining the second end respectively. The two end sections limit a working section that extends between the end sections. The working section of the reed serves for guiding the warp threads, whereas the end section is configured to fix the dents with each other or at a carrier of the reed respectively. The working section of each dent comprises two opposite dent outer surfaces. Each dent outer surface extends in a plane that is spanned by the longitudinal direction and a transverse direction that is orientated orthogonal to the longitudinal direction. The warp threads extend between two dent outer surfaces of two directly adjacent dents through the reed. Depending on the position of the weaving shaft, a warp thread can extend in transverse direction or inclined to the transverse direction.

Thus, each dent has a first dent outer surface that extends in a first plane and a second dent outer surface that extends in a second plane. The two planes are orientated parallel to each other and define the thickness of the dent in the working section. The dent outer surfaces are preferably rectangularly shaped and extend in length direction between the two end sections and in transverse direction between a front edge and a back edge of the dent.

In at least one end section of multiple and preferably all dents, a plurality of spacer studs is present. The spacer studs are particularly produced by an embossing process. It is preferred, if the dent comprises spacer studs in both end sections. The spacer studs are deepened at a first side relative to the first plane and are raised at the opposite second side relative to the second plane. Thus, each spacer stud forms a depression at the first side relative to the first plane and a projection at the second side relative to the second plane. The spacer studs are distributed in an end section and preferably arranged with distance to each other. The arrangement of the spacer studs in an end section is preferably carried out according to a regular pattern.

At the first side the spacer studs have a stud inner surface that adjoins the first plane and that forms a concave depression relative to the first plane. At the second side the studs have a stud outer surface that adjoins the second plane and that forms a convex projection relative to the second plane. The sum of all stud outer surfaces of all of the spacer studs that are arranged in a common end section has an amount of at most 15%, preferably at most 10% and further preferably at most 8% of the total end section surface in this end section. The total end section surface is defined by the sum of a surface area ratio of the end section that extends in the second plane in addition to the sum of all stud outer surfaces. Thus, the surface area section of the end section surface that extends in the second plane has an amount of at least 85%, preferably at least 90% and further preferably at least 92% of the total end section surface.

The spacer studs are configured to define a minimum distance between two adjacent dents in the reed. If a dent abuts against the spacer studs of the adjacent dent, the minimum distance between the working sections of the dents corresponds to the height of the spacer dent at the second side relative to the second plane. If the dents are glued to each other during the production of the reed, adhesive is inserted between the end section of the dents arranged adjacent to each other. Due to capillary forces, deformations of the end sections or the dent can occur. Because not all interspaces between end sections can be simultaneously filled with adhesive, irregular distances between the dents can be created due to the capillary forces or deformations of the dents can occur. Such deformations of the dents are limited by means of the spacer studs. Additionally, the spacer studs provide a minimum distance between two dents. Due to the fact that the spacer studs comprise a sufficiently small portion of the total stud outer surface relative to the total end section area, the capillary effect is not additionally enhanced. It has shown that due to spacer studs having a sufficiently small area proportion within the respective end section, an improved regularity of the dent distances compared with previous solutions can be achieved. The spacer studs can be simply and efficiently created due to an embossing process when producing the reed.

It is advantageous, if the percentage of the total stud inner surface of all spacer studs in a common end section at its first side has an amount of at most 15%, preferably at most 10% and further preferably at most 8% of the total end section area at this side. The total end section area at the first side is equal to the sum of the surface area section of the end section that extends in the first plane as well as the sum of all stud inner surfaces of the present spacer studs.

The spacer studs are preferably free of through-holes. They are, for example, created by means of a forming process. A separation process, like cutting or punching is not envisaged. It is also preferred, if the end sections in total are configured in a manner to be free of through-holes.

The reed comprises two lateral outer dents and a plurality of intermediate dents that are arranged between the lateral outer dents in a width direction, orthogonal to the first plane and the second plane, in which the dents are arranged in a row side by side. It is preferred, if at least all intermediate dents comprise spacer studs in one or both end sections respectively. Preferably at least one of the two lateral outer dents comprises spacer studs in at least one end section as well. In one embodiment it is provided that all of the dents comprise a plurality of spacer studs in one or both end sections respectively. In this embodiment all of the dents can be identically configured.

In a preferred embodiment at least three, preferably at least five to ten spacer studs are provided in one end section.

In a preferred embodiment each spacer stud has a central stud portion. The central stud portion is preferably rotationally symmetrically configured and can, e.g. have a cylindrical or truncated conically or ball scraper shaped form. Additionally, each spacer stud can comprise an outer stud portion that completely surrounds the central stud portion. In one embodiment the outer stud portion can be conically configured. The cone angle relative to the first or second plane is acute and has an amount of at most 10° or at most 5° or at most 3°.

The spacer studs of directly adjacently arranged end sections of the dents can be aligned with each other in one embodiment, i.e. all of the spacer studs of adjacent end sections are arranged along multiple straight lines that extend orthogonal to the first or second plane. Alternatively hereto the spacer studs of directly adjacent end sections respectively can also be arranged offset parallel to the first plane or the second plane, such that they are not aligned.

The spacer studs have a height or maximum height from the second plane that is preferably substantially equal to the distance between the first plane and the second plane, this means equal to the thickness or width of the dent. The height can have an amount of 0.8 multiple to the 1.2 multiple of the thickness of the dent.

In one embodiment the spacer studs have a diameter that is 5-10 times as large as the height.

It is preferred, if all of the spacer studs have the same diameter and the same height. It is further preferred, if all of the spacer studs have the same form or outer shape respectively.

In the arrangement in the reed directly adjacent dents have a dent spacing from each other that corresponds at least to the height of the spacer studs and is preferably at most 5% or at most 2% larger than the height of the spacer studs. Directly adjacent dents can abut with each other at the spacer studs or can be arranged without contact side by side.

For producing the reed the dents are subsequently supplied to an assembly station. Before the assembly station is reached at least one or multiple and preferably all of the dents are embossed in the end sections in order to create the spacer studs. It is also possible to emboss the dents in a separate embossment station and to supply them to a separate assembly station subsequently. In the assembly device or assembly station all of the dents are positioned with defined distance to each other, wherein the distance corresponds at least to the height of the spacer studs. In doing so, the dents can be preliminarily attached to each other in the desired relative position by means of a wire. Subsequently an adhesive bond between the respective adjacent end sections of the dents is created. For example, the dents can be glued with each other and with a carrier of the reed. The wire for preliminary fixing of the dents can be removed after curing of the adhesive bond.

BRIEF DESCRIPTION OF THE DRAWINGS

Preferred embodiments of the invention are derived from the dependent claims, the description as well as the drawings. In the following preferred embodiments of the invention are explained in detail with reference to the attached drawings. The drawings show:

DETAILED DESCRIPTION

Figure 1:
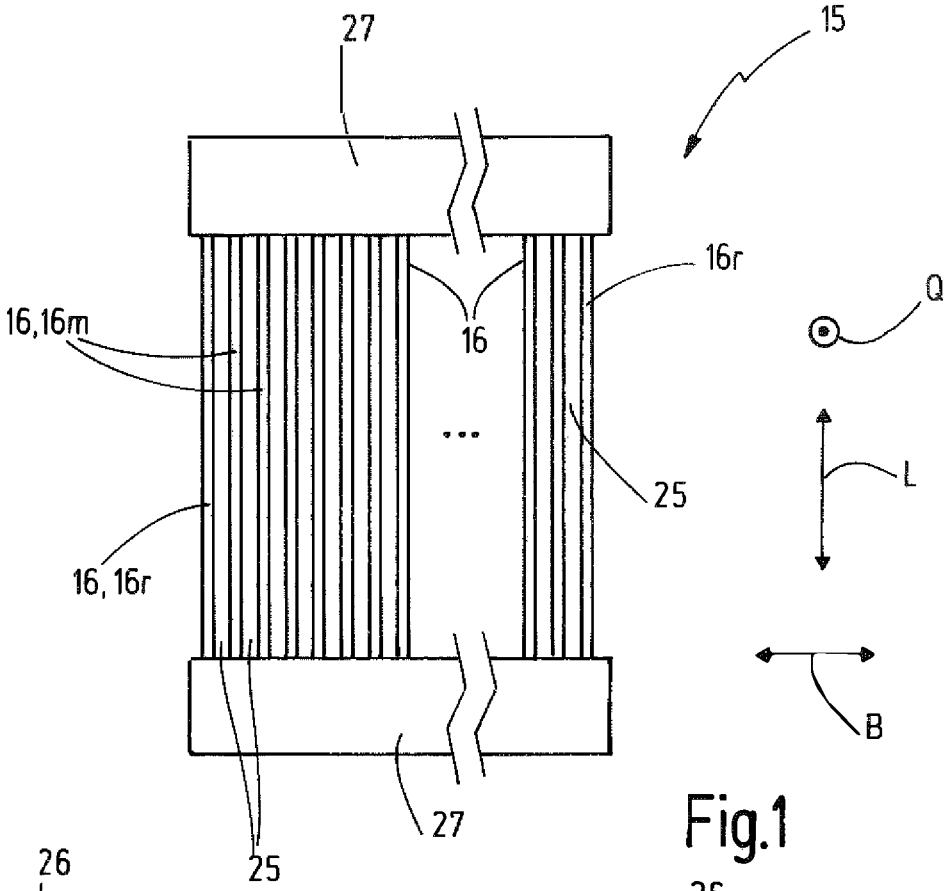
FIG. 1 a schematic illustration of a reed in a view in warp thread direction, FIGS. 2 and 3 a schematic illustration respectively of multiple dents of a reed in a cross-section, FIG. 4 a schematic illustration of an inventive embodiment of a dent in a top view in warp thread direction, FIG. 5 a preferred embodiment of a spacer stud in a cross-section through the end section of the dent of FIG. 4, wherein spacer studs of adjacent dents are arranged in an aligned configuration, FIG. 6 an enlarged illustration of the area VI in FIG. 5, FIG. 7 the embodiment of the spacer stud of FIG. 5, wherein the spacer studs are arranged offset to each other, FIG. 8 a schematic illustration of the positioning of multiple dents of a reed, FIGS. 9 and 10 a schematic illustration of an end section of a dent respectively with multiple spacer studs in different arrangement and FIG. 11 a schematic block diagram like illustration of an exemplary method procedure for producing an inventive reed.
Figure 4:
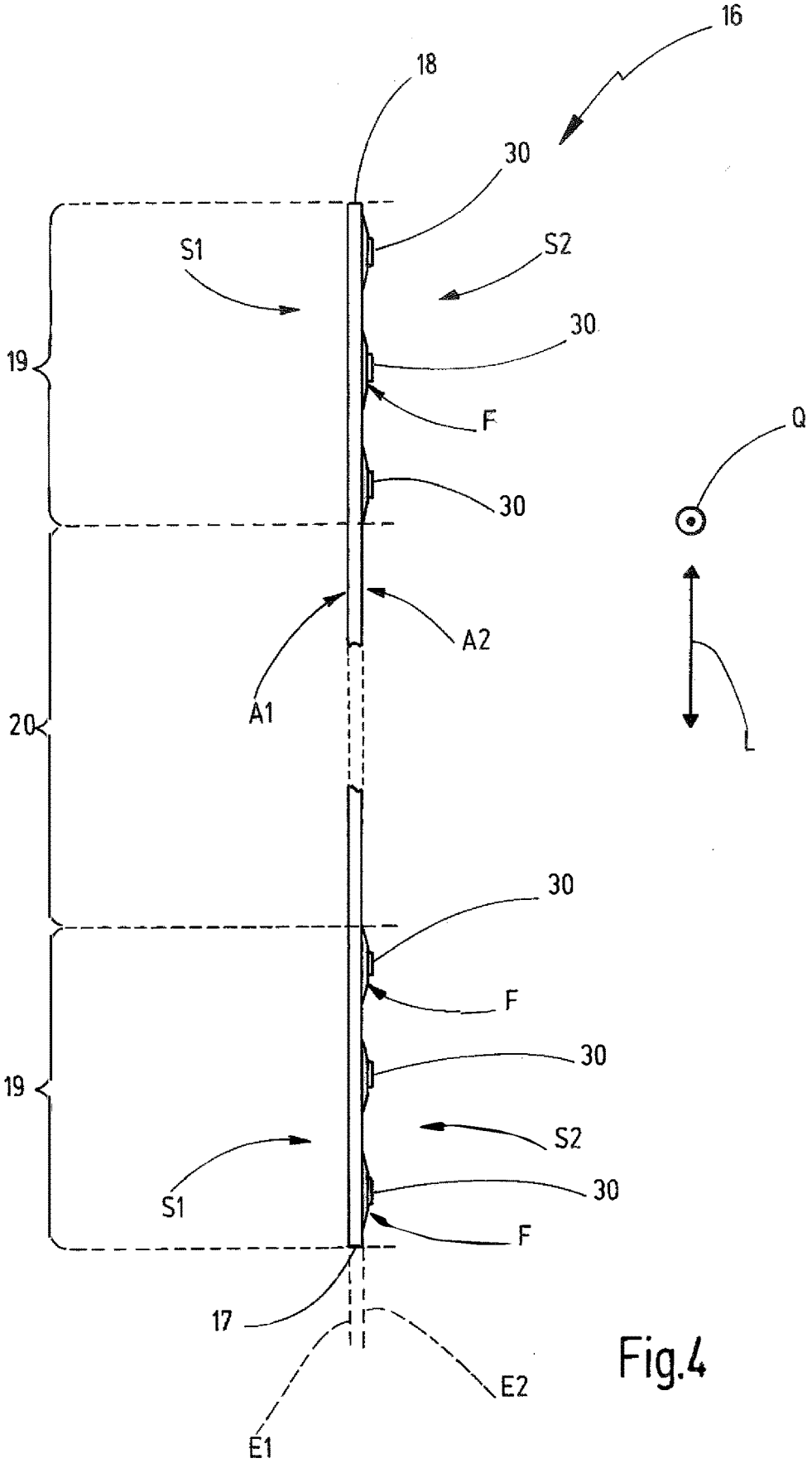

A reed 15 is schematically illustrated in FIG. 1. The reed 15 comprises a plurality of dents 16 that are orientated parallel to each other and arranged with distance to each other. Each dent 16 has a first end 17 and a second end 18 and extends in longitudinal direction L between the first end 17 and the second end 18 (FIG. 4). The two ends 17, 18 form faces or edges of the dent 16. A respective end section 19 adjoins the first end 17 and the second end 18 respectively. In longitudinal direction the two end sections 19 are separated from each other by a working section 20 of the dent 16 that is arranged in between. The first end 17 and the second end 18 are connected with each other by two edges, a front edge 21 and a back edge 22 that extend in longitudinal direction L. The front edge 21 and the back edge 22 are arranged with distance to each other in transverse direction Q.

Each of the dents 16 has a first dent outer surface A1 in the working section 20 and on the opposite side in the working section 20 a second dent outer surface A2 (FIG. 4). The first dent outer surface A1 extends in a first plane E1 and the second dent outer surface A2 extends in a second plane E2. The two planes E1, E2 are orientated parallel to each other and are spanned by the longitudinal direction L and the transverse direction Q.

The dents 16 of the reed 15 are arranged in a width direction B involving the formation of defined interspaces 25 between the working sections 20 of directly adjacent dents 16. In the width direction B the interspaces 25 have the same size. The interspaces 25 serve to guide warp threads 26 in the width direction B and to preset the distance between the warp threads 26 in width direction B and to keep it constant. As shown in FIG. 1, the dents 16 are arranged in an assigned carrier 27 of the reed 15 with their end sections 19. The dents 16 can be connected with their end sections 19 to the carriers 27 of the reed 15 by means of an adhesive bond. Due to the adhesive bond, also the end sections 19 of the dents 16 that are arranged side by side in width direction B are also connected with each other. The adhesive bond between the end sections 19 of the dents 16 and the respective carrier 27 is highly schematically illustrated in FIG. 11. An adhesive 28 is illustrated in a dotted manner in FIG. 11. It is apparent that the adhesive 28 flows in the gaps between two respectively adjacent end sections 19 of the dents 16.

Figure 2:
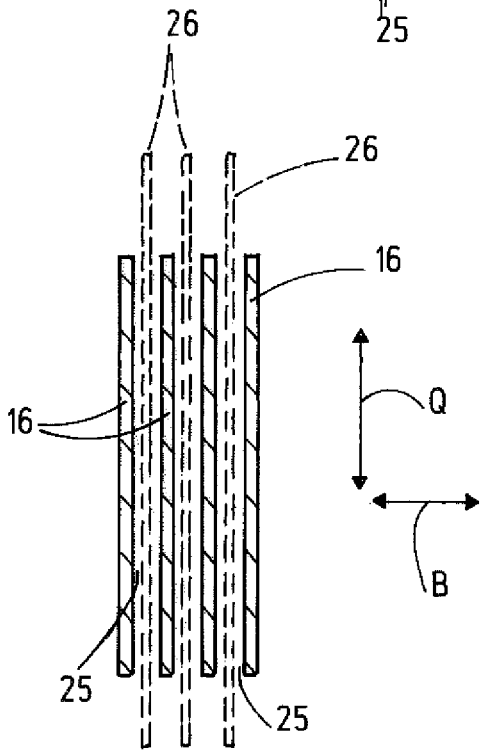
Figure 3:
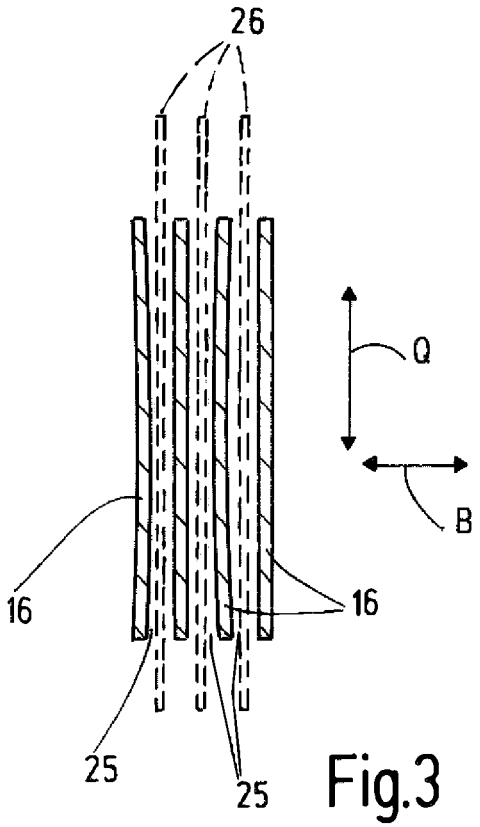

An ideal desired orientation of the dents 16 is schematically illustrated in FIG. 2. All of the dents 16 are orientated parallel with each other having equal distances respectively. In the practice the production of the adhesive bond between the end sections 19 of the dents can have the result that individual end sections 19 or individual dents 16 deform. This can be explained by the fact that the adhesive flow irregularly and not simultaneously in the respective gaps between the adjacent end sections 19. Capillary forces are created that can deform the very thin dents 16 of the reed 15. Such an undesired deformation is exemplarily illustrated in FIG. 3.

In order to counteract this, some or preferably all dents 16 have multiple spacer studs 30 in one and according to the example in both end sections 19 respectively. According to the example, in one end section 19 at least three and preferably five to ten spacer studs 30 are present. The working section 20 is free of spacer studs 30 and other depressions or elevations at the dent 16. The end section 19 adjoining the first end 17 ends at the location at which a spacer stud 30 is located that has the largest distance to the first end 17. The end section 19 adjoining the second end 18 ends at the location at which a spacer stud 30 is located that has the largest distance to the second end 18. At this location with the largest distance of a spacer stud from the first end 17 or the second end 18 a straight line G is drawn in transverse direction Q parallel to the respective edge of the first end 17 or the second end 18 respectively that forms the end of the respective end section 19 (FIGS. 9 and 10).

In the preferred embodiment the spacer studs 30 are created by embossing. They are deepened relative to the first plane E1 at a first side S1 and are elevated at an opposite second side S2 relative to the second plane E2. A preferred embodiment of the spacer studs 30 is shown in cross-section in FIGS. 5-7 respectively.

The second side S2 of the spacer studs 30 is located at the side of the dent 16 at which the second dent outer surface A2 adjoins in the working section 20. Accordingly, the first side S1 of the spacer studs 30 is located at the side of the dent 16 at which the working section 20 has its first dent outer surface A1 (FIG. 4). At the first side S1 each spacer stud has a stud inner surface I that adjoins to the first plane E1 and limits the concave deepened area of the spacer stud 30. On the opposite second side S2 each spacer stud 30 has a stud outer surface F that adjoins the second plane E2 and limits the convex projecting or elevating part of the spacer stud 30. The stud inner surface I and the stud outer surface F are shown in FIG. 5.

The number and size of the spacer studs 30 in one single end section 19 is selected, such that the sum of all stud outer surfaces F compared with the total end section area of this end section 19 on the second side S2 has an amount of at most 15% or at most 10% or at most 8%. The total end section area on the second side S2 is the area that is formed by the surface area section of the end section extending in the second plane E2 in addition to the sum of the stud outer surfaces F. Additionally or alternatively, the percentage of the sum of all stud inner surfaces I in one common end section 19 has an amount of at most 15% or at most 10% or at most 8% of the total end section area on the first side S1. The total end section area on the first side S1 is the area of the end section 19 resulting from the sum of all of the stud inner surfaces I of all of the spacer studs 30 in this end section 19 in addition to the surface area section of the end section 19 that extends in the first plane E1.

In the herein preferred embodiment all of the spacer studs 30 of a common end section 19 or a dent 16 and preferably all of the dents 16 are configured identically. In doing so, the production of the spacer studs 30 or the dents 16 is simplified.

Figure 5:
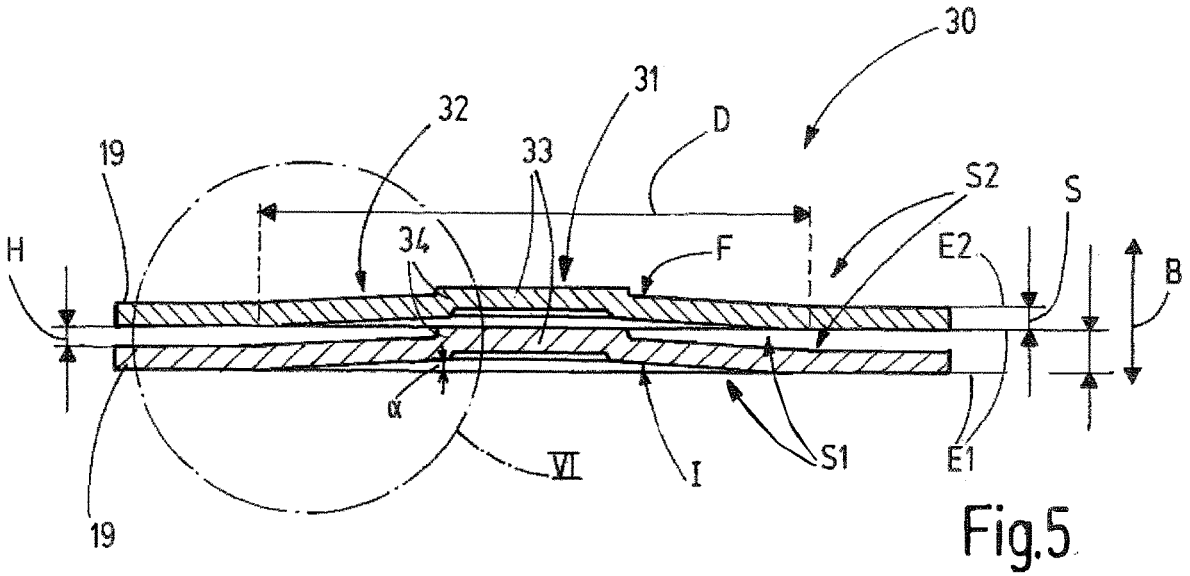
Figure 6:
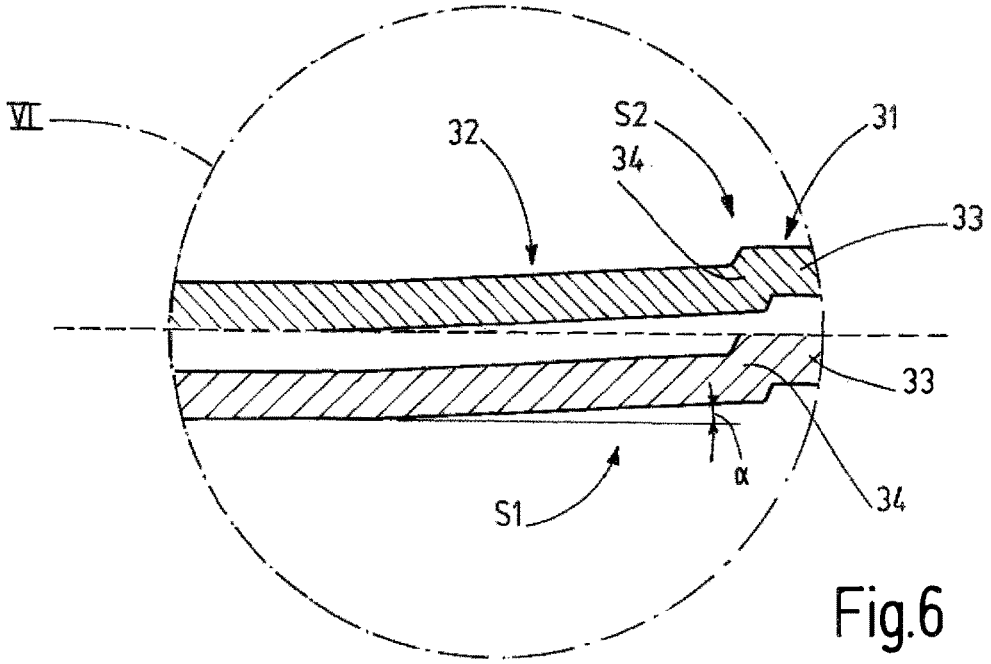
Figure 7:
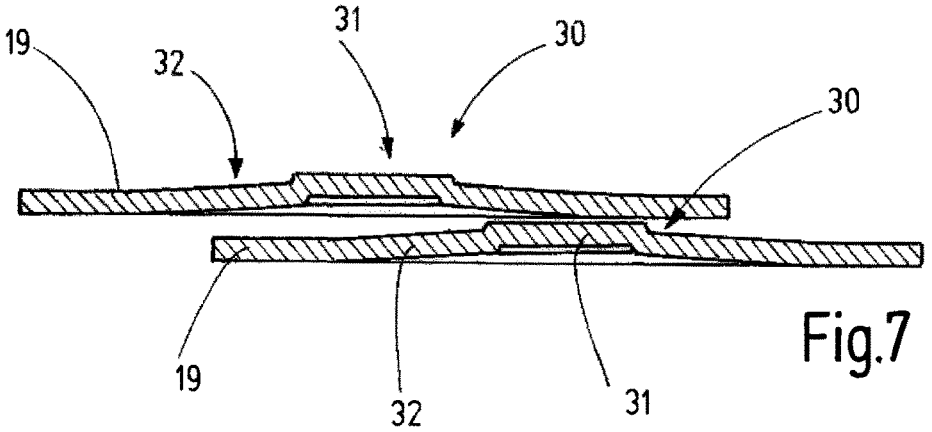

As it is apparent in FIGS. 5-7, in the preferred embodiment described herein each spacer stud 30 has a central stud portion 31 that is surrounded by an outer stud portion 32. The central stud portion 31 is preferably rotationally symmetrically configured to an axis that extends in the width direction B and thus orthogonal to the planes E1, E2. The central stud portion 31 can be configured cylindrically or in the form of a truncated cone or in the form of a ball scraper.

In the embodiment illustrated herein the central stud portion 31 has a central wall section 33 that extends substantially parallel to the second plane E2. This central wall section 33 can also be configured in a convex curved manner with view from the second side S2 onto the spacer stud 30. The central wall section 33 is, e.g. circular and connected with the outer stud portion 32 by a connection wall section 34. The connection wall section 34 has a conical shape and forms a hollow truncated cone. The connection wall section 34 extends the diameter of the central stud portion 31 from the central wall section 33 toward the outer stud portion 32. If the central wall section 33 has the shape of a ball scraper or another convex curved form, the connection wall section 34 can also be omitted.

The outer stud portion 32 is optional and can be omitted in a non-illustrated embodiment. In the preferred embodiment it serves to provide a spring effect to the spacer stud 30. For this the outer stud portion 32 has a conical shape and forms a hollow truncated cone. A cone angle $\alpha$ of the outer stud portion 32 measured between the first plane E1 and the stud inner surface I is very small and has an amount of less than 5° or less than 3° in the preferred embodiment. A cone angle of the connection wall section 34 is, however, larger and has an amount of preferably at least 30° or at least 40°.

As it is illustrated in FIG. 5, the spacer studs 30 of adjacent end sections 19 of the dents 16 can be arranged in the width direction B aligned with each other. The spacer studs 30 are, e.g. created by a forming process and preferably an embossing process. Due to the forming and the created material flow, the dimension of a spacer stud 30 on the second side S2 is larger than on the first side S1. Therefore, it is avoided that adjacent dents 16 abut against each other completely without distance also in case of an aligned arrangement of the spacer studs 30. Alternatively to the schematic illustrations in FIGS. 5 and 6, the spacer studs 30 of directly adjacent end sections 19 of two dents 16 can also be arranged offset from each other parallel to the planes E1, E2 (FIG. 7). Apart therefrom the configuration of the spacer studs 30 in FIG. 7 corresponds to the configuration in FIGS. 5 and 6.

Starting from the second plane E2 the spacer stud 30 has a height H that defines the location with the largest distance to the second plane E2. In the embodiment described herein the height H is defined by that portion of the stud outer surface F that is located at the central wall section 33. This height H of the spacer stud 30 defines the minimum distance that two directly adjacent dents have in the area of their working sections 20. The height H corresponds preferably substantially to the thickness or width S of the dent 16. The width S of the dent 16 is defined by the distance between the first plane E1 and the second plane E2. In the embodiment described herein the diameter D of the spacer stud 30 has an amount of about 8 to 12 times and preferably 10 times of the height H. If the outer stud portion 32 is omitted in a not illustrated embodiment, the diameter D of the spacer stud 30 has an amount of about 4 times to 6 times and preferably 5 times of the height H.

As explained above, all of the dents 16 can comprise spacer studs 30 in both end sections 19 respectively. In order to guarantee the minimum distance between the dents 16 the provision of spacer studs 30 at all of the dents 16 is not necessarily required. As illustrated in FIG. 1, the reed 15 has with view in width direction B two lateral outer dents 16*r* and intermediate dents 16*m* that are arranged in between. At least one of the lateral outer dents 16*r* does not require spacer studs, because only at one side of the lateral outer dents 16*r* an intermediate dent 16*m* is present. If this adjacent intermediate dent 16*m* comprises spacer studs toward the lateral outer dent 16*r*, the lateral outer dents 16*r* can be configured without spacer studs. If the spacer studs 30 of dents 16 are arranged in aligned configuration in width direction B, preferably all of the dents 16 comprise spacer studs. For unifying of the manufacturing of the dents 16 and in order to guarantee that each dent 16 can be used at any location in the reed 15, preferably all of the dents 16 are provided with spacer studs 30 in at least one or both end sections 19.

The number and position of the spacer studs 30 in an end section 19 can vary. Only by way of example two possibilities of arrangement are illustrated in FIGS. 9 and 10. In the embodiment shown in FIG. 10 the spacer studs 30 are matrix-shaped arranged in rows and columns with regular distances in the end sections 19. In the embodiment illustrated in FIG. 9 the rows that are directly adjacent in longitudinal direction L are offset in transverse direction Q. The possibilities of arrangement of the spacer studs in the end sections 19 are versatile. Also irregular arrangement variations are possible. It is substantial that the inventive surface area percentage of the spacer studs compared with the total end section area is observed in order to keep the capillary forces during creation of the adhesive bond small and to, however, guarantee a minimum distance between directly adjacent dents 16 for creation of the interspace 25.

Figure 11:
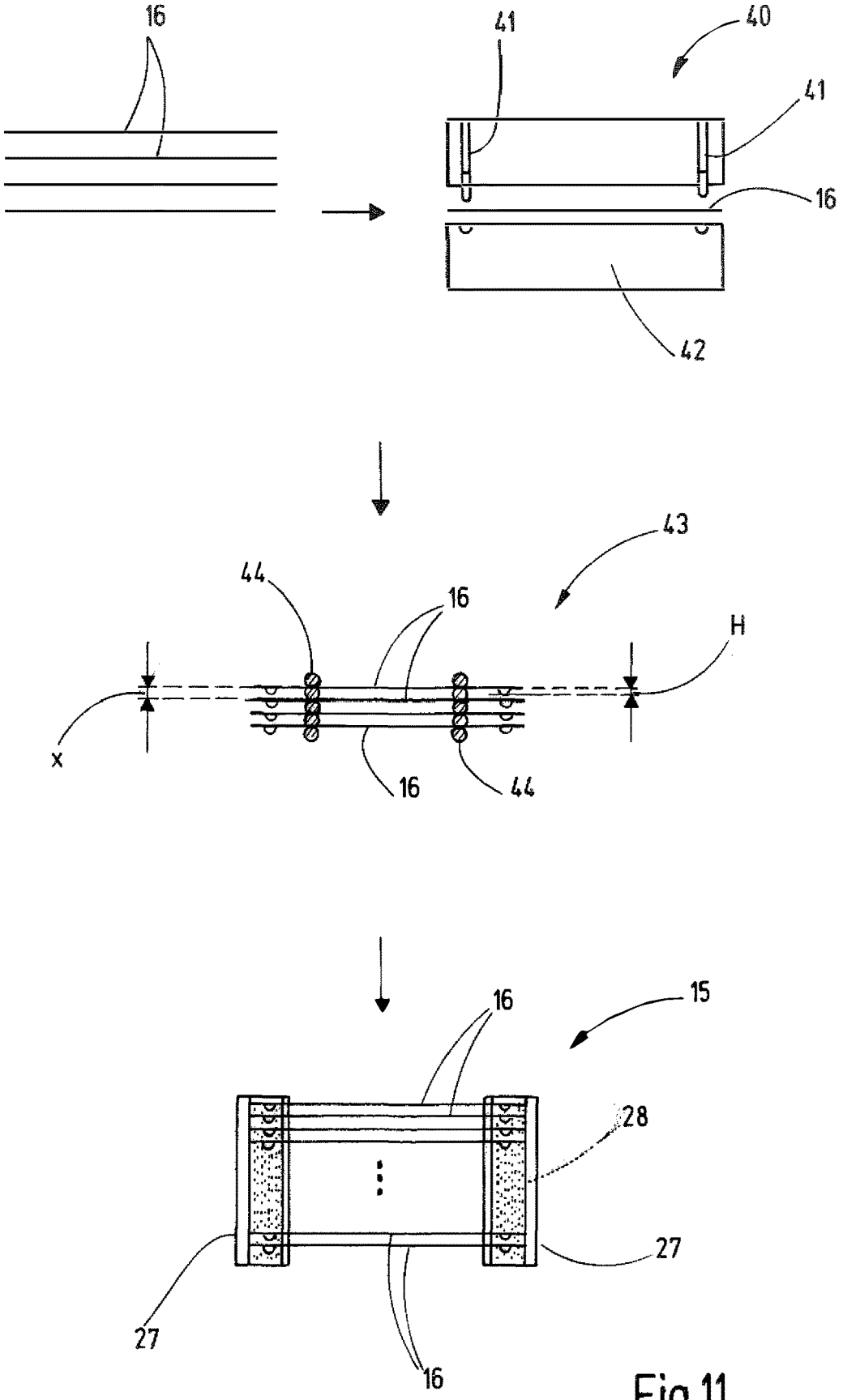

Method steps for producing the reed 15 are schematically illustrated in FIG. 11. First the dents 16 are provided as band-shaped or strip-shaped foil or metal sheet parts. These dents 16 are embossed in an embossment station 40 in order to create the spacer studs 30 in the end sections. For this the embossment station 40 comprises one or more embossment stamps 41 that cooperate with a die 42 in order to create the spacer studs 30.

Subsequently the embossed dents 16 are positioned and orientated relative to each other in an assembly station 43. In doing so, a dent spacing x is adjusted between directly adjacent dents 16 or their working sections 20 that is preferably slightly larger than the height H of the spacer studs. For example the height H of a spacer stud can have an amount of about 0.015 mm to 0.025 mm and the dent spacing x can be at most 10% or at most 5% larger than the height H of the spacer studs. In the non-aligned orientation of the spacer studs (FIG. 7) the minimum distance or the smallest dent spacing x is equal to the height H of the spacer studs 30. In case of the aligned orientation, if the spacer studs 30 comprise an outer stud portion 32, the central stud portion 31 can engage at its second side S2 at least partly into the depression provided there at the first side S1 of the adjacent spacer stud 30. The minimum distance or the smallest dent spacing x between two adjacent dents 16 can thus be smaller than the height H of the spacer studs 30 (compare FIGS. 5 and 6). In all cases, however, a minimum distance between directly adjacent dents 16 is guaranteed by the spacer studs 30.

In the assembly station 43 the positioned and aligned dents 16 can be preliminarily attached to each other by means of a preferably flexible or bendable fixing means, such as a wire 44. In this preliminarily fixed condition the adhesive bond between the end sections 19 of the dents 16 arranged side by side to each other in width direction B and assigned to a common carrier 27 is created. In doing so, adhesive 28 flows in the gap between the adjacent end sections 19 and thus creates an adhesive bond. Because of the small spacer studs 30 in terms of their area, it is guaranteed that on one hand a minimum distance between the dents 16 is guaranteed and on the other hand capillary forces are kept sufficiently small. During the creation of the adhesive bond between the dents 16 also an adhesive bond is created with the respective carriers 27.

The embossing station 40 and the assembly station 43 can form part of a common device or machine. The manufacturing process can be carried out in an automated manner.

The dent spacing x is preferably adjusted in the assembly station 43 by a highly precise machine axis.

The invention refers to a reed 15 and a method for producing the same. The reed 15 comprises a plurality of dents 16 that are arranged in a width direction B at a dent spacing x respectively, thereby forming interspaces 25. Each dent 16 has two opposite end sections 19 at which it is connected with a carrier 27 and with the directly adjacent dent or dents 16 by means of an adhesive bond respectively. In at least one or in both end sections 19 the dent 16 has a plurality of spacer studs 30 that are preferably created by embossing. The spacer studs 30 form a depression on the one first side S1 and on the opposite second side S2 a projection with a stud outer surface F. The sum of all stud outer surfaces F of the spacer studs 30 of one single end section 19 of a dent 16 has a percentage of at most 15% or at most 10% or at most 8% of the total end section area on this second side S2.

LIST OF REFERENCE SIGNS

15 reed
16 dent
16*m* intermediate dent
16*r* lateral outer dent
17 first end
18 second end
19 end section
20 working section
21 front edge
22 back edge
25 interspaces
26 warp thread
27 carrier
28 adhesive
30 spacer studs
31 central stud portion
32 outer stud portion
33 central wall section
34 connection wall section
40 embossment station
41 embossment stamp
42 die
43 assembly station
44 wire
α cone angle of the outer stud portion
A1 first dent outer surface
A2 second dent outer surface
B width direction
D diameter of the spacer stud
E1 first plane
E2 second plane
F stud outer surface
G straight line
H height of the spacer stud
I stud inner surface
L length direction
Q transverse direction
S width of the spacer stud
S1 first side
S2 second side
x dent spacing

The invention claimed is:

1. A reed (15), comprising:

a plurality of dents (16) that extend in a longitudinal direction (L) between a first end (17) and an opposite second end (18), wherein individual ones of the plurality of dents (16) have end sections (19) adjoining the first end (17) and the second end (18) respectively and have a working section (20) between the end sections (19), whereas individual ones of the plurality of dents (16) have a first dent outer surface (A1) extending in a first plane (E1) in the working section (20) and have a second dent outer surface (A2) extending in a second plane (E2) in the working section (20), wherein the two planes (E1, E2) are orientated parallel to each other, wherein in at least one end section (19) of at least one of the plurality of dents (16) multiple spacer studs (30) are present that are deepened at a first side (S1) compared with the first plane (E1) respectively and that are raised at a second side (S2) compared with the second plane (E2), wherein a percentage of a sum of the stud outer surface areas (F) of all of the multiple spacer studs (30) at their second side is at most 15% of a total end section surface area of a common end section (19) at the second side, and an adhesive bond is created between adjacent end sections (19) of individual ones of the plurality of dents (16).

2. The reed according to claim 1, wherein the multiple spacer studs each have an inner surface area (I) at the respective first sides (S1) thereof and a percentage of a sum of the stud inner surface areas (I) of all of the multiple spacer studs (30) is at most 15% of the total end section surface area at the first side.

3. The reed according to claim 1, wherein individual ones of the multiple spacer studs (30) are free of through-holes.

4. The reed according to claim 1, wherein individual ones of the end sections (19) of the plurality of dents are free of through-holes.

5. The reed according to claim 1, wherein the plurality of dents comprises two outer dents (16*r*) and multiple intermediate dents (16*m*), wherein at least all of the intermediate dents (16*m*) comprise spacer studs (30) in one or both end sections (19).

6. The reed according to claim 1, wherein all of the plurality of dents (16) comprise spacer studs (30) in one or both end sections (19).

7. The reed according to claim 1, wherein each of the multiple spacer studs (30) has a central stud portion (31).

8. The reed according to claim 7, wherein each of the multiple spacer studs (30) has an outer stud portion (32) that surrounds the central stud portion (31).

9. The reed according to claim 7, wherein each of the multiple spacer studs (30) has an outer stud portion (32) that surrounds the central stud portion (31) and the central stud portion (31) is conical or cylindrical or ball shaped and/or the outer stud portion (32) is conical.

10. The reed according to claim 1, wherein individual ones of the multiple spacer studs (30) of directly adjacent end sections (19) of two of the plurality of dents (16) are aligned with respect to each other.

11. The reed according to claim 1, wherein individual ones of the multiple spacer studs (30) have a height H compared with the second plane (E2) that corresponds to the distance between the first plane (E1) and the second plane (E2).

12. The reed according to claim 1, wherein individual ones of the multiple spacer studs (30) have a diameter (D) and a height (H) from the second plane (E2), wherein the diameter (D) is 5 to 10 times as large as the height (H).

13. The reed according to claim 1, wherein individual ones of the plurality of dents (16) are connected via their two end sections (19) to a carrier (27) by an adhesive bond, wherein two directly adjacent dents (16) of the plurality of dents respectively either do not abut against each other or spacer studs (30) of one of the two directly adjacent dents (16) abut with the second side (S2) of the respective other directly adjacent dent (16).

14. A method for producing a reed (15) according to claim 1 comprising the following steps:

Embossing at least one of the plurality of dents (16) for creating the multiple spacer studs (30) in at least one end section (19) of the at least one dent (16) in an embossment station (40), Positioning individual ones of the plurality of dents (16) with a defined distance with respect to each other in an assembly station (43), Creating an adhesive bond between individual ones of the adjacent end sections (19) of the plurality of dents (16).

* * * * *